United States Patent [19]

Gamble

[11] 4,014,241

[45] Mar. 29, 1977

[54] SYNTHETIC WOODWIND REED

[76] Inventor: George W. Gamble, One Phlox Lane, Acton, Mass. 01720

[22] Filed: Feb. 11, 1976

[21] Appl. No.: 657,077

[52] U.S. Cl. ..... 84/383 A
[51] Int. Cl.[2] ..... G10D 9/02
[58] Field of Search ..... 84/380 A, 383 A

[56] References Cited

UNITED STATES PATENTS

| | | | |
|---|---|---|---|
| 1,667,836 | 5/1928 | Brockman | 84/383 A |
| 2,296,737 | 9/1942 | Peterson | 84/383 A |
| 2,342,836 | 2/1944 | Brilhart | 84/383 A |
| 3,905,268 | 9/1975 | Gamble | 84/383 A |

*Primary Examiner*—Lawrence R. Franklin
*Attorney, Agent, or Firm*—Russell & Nields

[57] ABSTRACT

A synthetic woodwind reed comprising a root portion and a tapering vamp portion, each portion having a flat base surface and a curved surface. Located in both surfaces of the vamp portion are channels, whereby a transverse cross-section of the vamp region comprises a plurality of alternating thicker and thinner regions, the thinner regions being near but not necessarily on the center of gravity of the cross-section. The transverse cross-section of the read is thicker near the longitudinal centerline than at the edges. The synthetic material has a sufficiently high elastic limit to fully recover from longitudinal and transverse bending within each operating cycle. By forming a matched pair from two reeds as described above, but modified in that the base surface of each is concave rather than flat, a double reed is formed suitable for use with such instruments as an oboe or bassoon.

11 Claims, 20 Drawing Figures

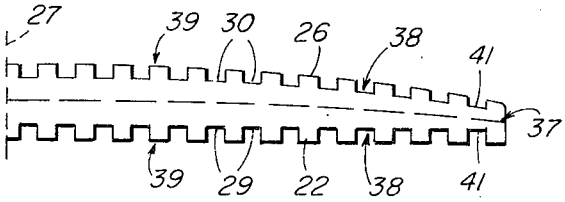
FIG. 15
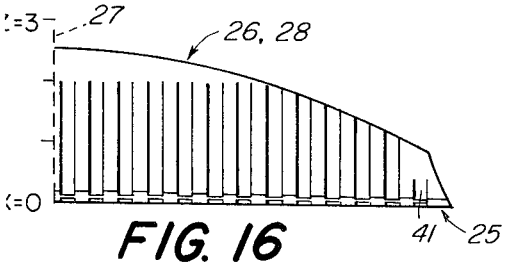
FIG. 16
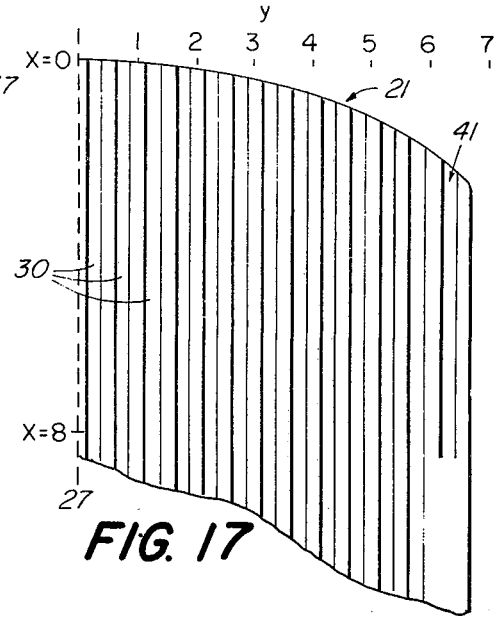
FIG. 17
FIG. 12
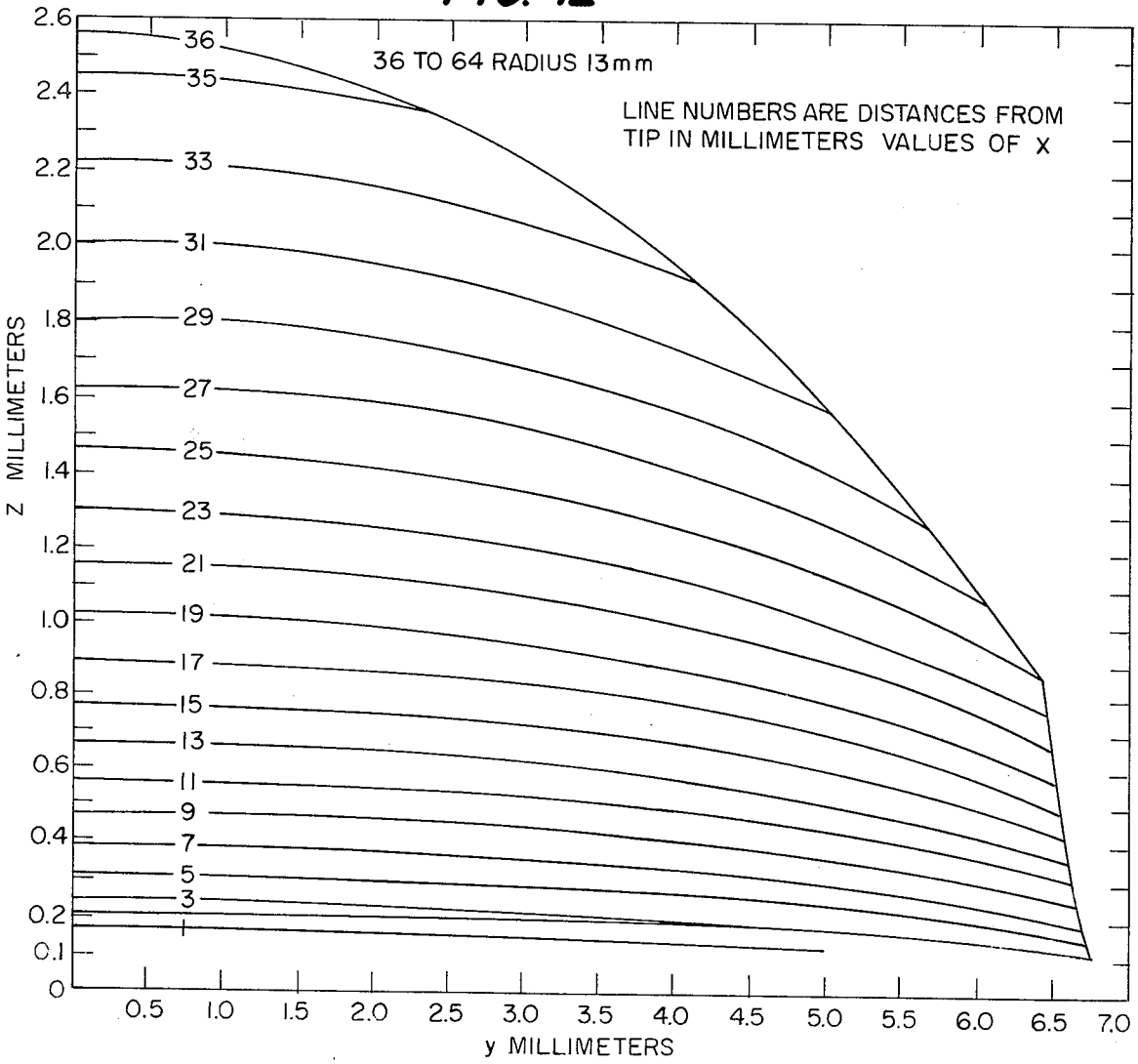

SYNTHETIC WOODWIND REED

BACKGROUND OF THE INVENTION

The field of the present invention is reeds for woodwind instruments, including clarinets, saxophones, oboes and bassoons. Presently, woodwind musicians prefer reeds constructed of natural cane fiber, due to the superior quality of sound and range of fluctuation attainable. The natural cane reed does have disadvantages however. First, the cane reed has a very short life span. The tip deteriorates rapidly upon contact with saliva, and becomes flabby and difficult to play. Secondly, the cane reed is unpredictable. No two pieces of cane are alike, and although the reed may be constructed with identical dimensions, it is extremely difficult to ensure identical musical quality and characteristics. Thirdly, the cane reed is not hygienic, in that saliva cannot be completely removed after playing.

As a result of the disadvantages of natural cane reed, the need exists for a synthetic reed which overcomes these deficiencies but which preserves the operating performance of cane. Many attempts have been made to fabricate reeds from synthetic materials or composite materials. The synthetic or composite reeds of the prior art have not, however, been successful in imitating the musical qualities of natural cane reed, for users still prefer cane reeds.

The present invention comprehends a synthetic woodwind reed which simulates the across grain and along grain elastic properties of natural cane reed. With respect to the across grain properties, natural cane reed exhibits an anisotropic effect, whereby it is relatively easier to bend the reed in the transverse direction than in the longitudinal direction. Plastics, on the other hand, exhibit isotropic bending behavior. With respect to the along grain properties of natural cane reed, the extremes of longitudinal flexure must be kept small.

The prior art reveals various means for replacing the cane reed with an artificial reed. In U.S. Pat. No. 2,296,737 stiffening rills of the smallest possible radius of curvature are placed longitudinally on the tapered topside of the vibrating tip portion. The composite structure of U.S. Pat. No. 3,759,132 is made of longitudinal stiffening ribs and low density filler material. In some instances longitudinal stiffening members and cavities are located in the underside of the vibrating tip portion of the reed. Examples may be found in U.S. Pat. Nos. 2,224,308 and 3,905,268. Unlike the present invention, the reed of U.S. Pat. No. 2,224,308 is much denser and stiffer at the longitudinal margins than in the central portion. The reed of U.S. Pat. No. 3,905,286 has an arched vamp which, in cross-section, resembles a bow. To increase longitudinal stiffness, the area moment of inertia is maximized along the central longitudinal axis. The net effect of this configuration is to move the center of gravity of the reed toward the vamp surface, for the patent does not disclose recesses in the top tapered surface of the vamp. The prior art does not disclose an artificial reed which duplicates the motion or feel of natural cane reed. The object of the present invention is to duplicate the cane reed in every essential detail, and thereby provide the first truly satisfactory substitute for the cane reed.

SUMMARY OF THE INVENTION

The present invention comprehends a synthetic reed for woodwind instruments which imitates the motion of a natural cane reed. The present invention imitates the anisotropic bending behavior of a natural cane reed due to a novel geometry and a high elastic limit. The overall dimensions of the present invention are similar to those of the conventional reed. The tapered vamp portion of the present invention, however, contains channels in both the tapering surface and the flat base surface. As a result of this particular geometry, the transverse cross-section of the vamp region comprises a plurality of alternating thicker and thinner regions, the thinner regions being near but not necessarily on the center of gravity of the cross-section. The thicker regions provide longitudinal stiffness, and the thinner regions permit extreme transverse curvatures near the tip of the reed. Furthermore, the typical transverse cross-section of the reed is thicker near the longitudinal centerline than at the edges. The reed of the present invention is thus progressively less stiff away from its centerline, permitting the edges to be most compliant. Due to the high degree of transverse bending, the synthetic material of the present invention must have a sufficiently high elastic limit in order to ensure complete elastic recovery within each operating cycle.

The present invention can also be adapted for use with double reed woodwind instruments, by applying the principles of the invention as disclosed herein.

DESCRIPTION OF THE DRAWINGS

FIG. 12 is a graph of the surface contours at various transverse cross-sections from the longitudinal centerline to the outer edge along the length of the reed of FIG. 3, without the channels shown;

FIG. 15 is a transverse cross-section from the longitudinal centerline to the outer edge of the vamp section of the reed of FIG. 3;

FIG. 16 is an end view of the reed of FIG. 3 from the longitudinal centerline to the outer edge;

FIG. 17 is a top view of the tip end of the reed of FIG. 3 from the longitudinal centerline to the outer edge;

DESCRIPTION OF PREFERRED EMBODIMENTS

Figure 1:
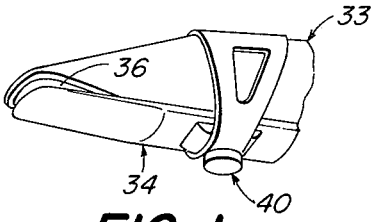
FIG. 1 is a perspective view of a reed clamped to a mouthpiece of a woodwind instrument.
Figure 2:
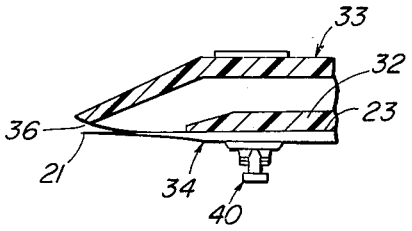
FIG. 2 is a longitudinal cross section of FIG. 1.

A preferred embodiment of the present invention is shown in the drawings. In reference thereto and first to FIGS. 1 and 2, therein are shown a reed 34 adapted to contact the face 32 and partially cover the air passageway 36 of a mouthpiece 33 of a woodwind instrument such as a $B^b$ clarinet. The reed 34 is adapted to be attached to the mouthpiece 33 at the face side 23 of the root region by means of a ligature clamp 40. The present invention can also be adapted for use with the entire family of clarinets, saxophones, bassoons, and oboes. The reed 34 is constructed of plastic, molded in a shape of novel geometry. In reference to FIGS. 3–6 the reed 34 has overall outer dimensions similar to those of a conventional cane reed. The reed 34 comprises a face side which forms a base 25, a curved exposed-side surface 35 opposite the base 25, a tip end 21, and a root end 24. The base 25 may be subdivided into the face side 22 of the vamp region and the face side 23 of the root region. The curved exposed-side surface 35 may be subdivided into the exposed side 26 of the vamp region and the exposed side 28 of the root region. The vamp region 22, 26 can best be described first in terms of its contour without channels, and then in terms of this contour having face-side channels 29 and exposed-side channels 30 therein. The contour of the exposed surface 35 varies in dimensions from the tip end 21 over the length of the exposed side 26 of the vamp region. This contour of the exposed side 26 of the vamp region, without consideration of the exposed-side channels 30, is defined by a contour equation equal to the smaller of the following two representations of $Z_{x,y}$ for the values of $0 \leq x \leq 36$ and $$0 \leq y \leq 6.781 - \frac{x}{64}:$$

$$(1)\ Z_{x,y} = Z_{x,0}\sqrt{1-\left(\frac{y}{7.91}\right)^2}$$

where $$Z_{x,0} = 0.003 \times e^{\frac{x}{44.5}} + 0.14$$

$x$ = length in millimeters from the tip end 21
$y$ = width in millimeters from the centerline 27
$Z$ = height in millimeters from the base 25 or (2) $Z_{x,y}$ = circular arc in $y,Z$ plane through $Z_{36,0}$ having curvature of 0.077 radians per millimeter The contour of the exposed side 26 of the vamp region can therefore not exceed the cylindrical contour of the exposed side 28 of the root region, as shown in FIG. 12. With reference to FIGS. 7–11, at the outer edges of any transverse cross-section of the exposed side 26 of the vamp region, the surface contour takes on a vertical height from the base 25 to $Z_{x,y}$ as defined by the contour equation for $y_{max}$.

Figure 5:
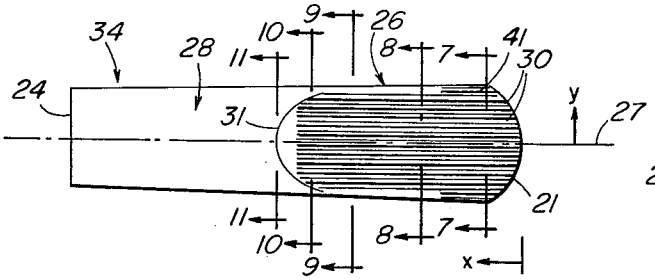
FIG. 5 is a diagrammatic bottom view of the reed of FIG. 3.

In reference to FIGS. 5 and 17, the tip end 21 of the reed is elliptical in shape, and defined by the following equation:

$$\left(\frac{4.267-x}{4.267}\right)^2 + \left(\frac{y}{8}\right)^2 = 1$$

where $$0 \leq x \leq 2$$

$$0 \leq y \leq 6.78$$

Figure 3:
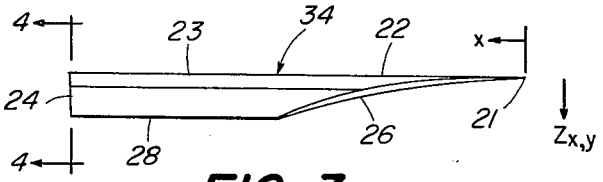
FIG. 3 is a longitudinal side view of one embodiment of the reed of the invention.
Figure 4:
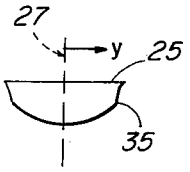
FIG. 4 is an end view along the line 4—4 of FIG. 3.
Figure 14:
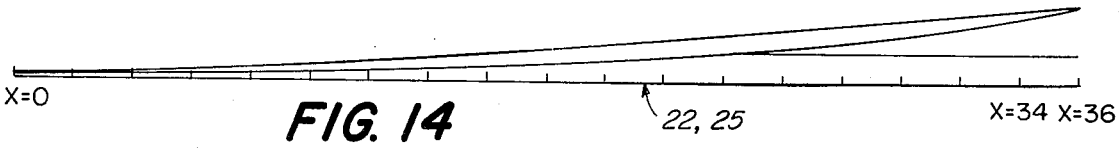
FIG. 14 is a longitudinal side view of the vamp region of the reed of FIG. 3.

The tip end 21 forms one border of the flexible vamp region 22, 26. As shown in FIGS. 3 and 14, this vamp region 22, 26 (without consideration of the channels 29, 30) increases exponentially in thickness from the tip end 21 to the intersection with the root region 23, 28 ($x$ = 36 millimeters). This increase in thickness is again defined by the above contour equation, and FIG. 14 depicts the height $Z_{x,0}$ above the base 25 of the reed at the centerline 27 for various values of $x$ along the length of the vamp region. It should be noted, however, that although the preferred embodiment shows an exponential increase in thickness of the vamp region, the arrangement of channels of the present invention can be applied to any flexible vamp of a reed adapted to be used with a woodwind instrument.

As shown in FIG. 5 the root end 24 has a narrower width than the tip end 21, for the reed as a whole is slightly tapered in width. This tapering in width over the length of the reed is defined, as indicated above, by the equation:

$$y_{max} = 6.781 - \frac{x}{64}$$

where $y_{max}$ = maximum width in millimeters from the centerline 27 of any cross-section along the length $x$ of the reed.

Figure 6:
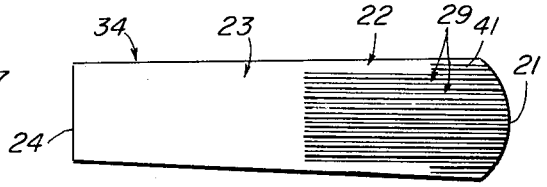
FIG. 6 is a diagrammatic top view of the reed of FIG. 3.
Figure 7:
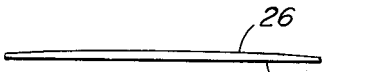
FIGS. 7 through 11 are transverse cross sections taken on lines 7—7, 8—8, 9—9, 10—10, 11—11 of FIG. 5, without the channels shown.
Figure 8:
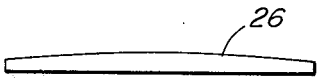
Figure 9:
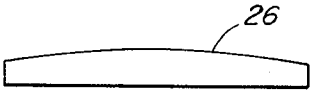
Figure 10:
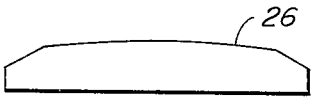
Figure 13:
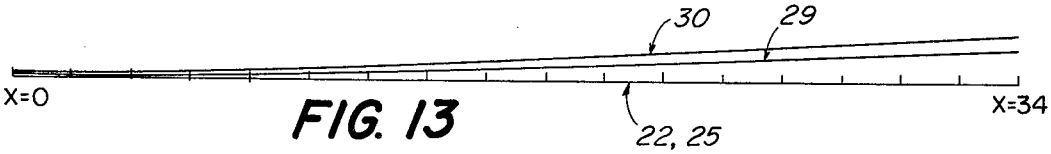
FIG. 13 is a graph of the distance of the bottoms of the sets of channels 29, 30 from the base 22 at the longitudinal centerline 27 of the reed of FIG. 3.

As shown in FIGS. 5, 6 and 15 the vamp region has channels 29, 30 on both the face side 22 and the exposed side 26. All of the face-side channels 29 have constant and equal widths, and as shown in FIG. 13, they increase in depth along the length of the vamp region 22. With reference to FIG. 15, at any transverse cross-section of the vamp region 22, 26 the thickness of the reed between the bottoms of the face-side channels 29 and the bottoms of the exposed-side channels 30 decreases elliptically across the width of the reed from the centerline 27, and is defined by the following equation:

$$Z'_{x,y} = \left[0.0065 \times e^{\frac{x}{44.5}} + 0.051\right]\sqrt{1-\left(\frac{y}{7.91}\right)^2}$$

The area of thickness between the two sets of channels 29, 30 is referred to as the inside envelope 38. The bottoms of both the face-side channels 29 and the exposed-side channels 30 are located equidistant from the center of gravity 37 of the outside envelope 39. This outside envelope 39 is defined by the height ($Z_{x,y}$) of the reed 34 from the base 25. Therefore, the depth of the exposed-side channels 30 is equal to that of the face-side channels 29 at each fixed value of $x$ and $y$, and numerically equal to half the difference between the height of the outside envelope 39 and the thickness of the inside envelope 38, $(1/2)(Z_{x,y} - Z'_{x,y})$. For ease of construction, however, the depth of the face-side channels 29 could be constant at any transverse cross-section. Likewise, the distance of the bottoms of the exposed-side channels 30 from the base 25 could also be constant. The face-side channels 29 are arranged whereby the alternating thicker and thinner portions of the cross-section are of equal width, as shown in FIG. 15. The exception to this regular alternating pattern occurs at the edges farthest from the centerline 27. Each of the face-side channels 29 extends a uniform distance of 34 millimeters from the tip end 21 in FIGS. 6 and 13, almost the entire length of the vamp region 22, with the exception of the outermost face-side and exposed-side channels 41 which extend approximately 6 millimeters from the tip end 21 as shown in FIG. 17.

As shown in FIGS. 5 and 15, the exposed side 26 of the vamp region also has channels 30 which are located opposite to and aligned with the corresponding face-side channels 29. All of the exposed-side channels 30 have constant and equal widths for the length of the channels. With reference to FIG. 13 the distance between the bottoms of the exposed-side channels 30 and the base 25 of the reed increases over the length of the vamp region 26. The mold for a synthetic reed will thus have longitudinal projections of varying depth corresponding to the bottoms of the exposed-side channels 30 and face-side channels 29. Unlike the face-side channels 29, the exposed-side channels 30 do not extend a uniform distance of 34 millimeters from the tip end 21. Instead, the exposed-side channels 30, except for the outermost channels 41, are bounded by the tip end 21 and by a parabolic curve 31 as shown in FIG. 5, but in no event do the exposed side channels 30 extend more than 34 millimeters from the tip end 21. The shape of this parabolic curve 31 is determined by the intersection between the individual contour line at any cross-section along the vamp region 26, as defined by the above elliptical contour equation $(Z_{x,y})$ for $0 \leq x \leq 36$, and the cylindrical contour of the root portion 28.

Figure 11:
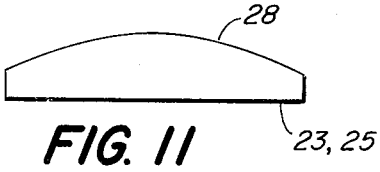

With reference to FIGS. 3, 11 and 12 the transition from the vamp region 22, 26 to the root region 23, 28 occurs at $x = 36$ in the contour equation given above. As with the face side 22 of the vamp region, the face side 23 of the root region is flat and forms part of the base 25. However, unlike the exposed side 26 of the vamp region, the exposed side 28 of the root region has a constant contour. This contour is defined by a circular arc in the transverse $(y,Z)$ plane, having a curvature of 0.077 radians per millimeter. The midpoint of the arc passes through a height of $Z_{36,0}$ above the centerline 27 in the base 25 of the reed. The arc terminates at $y_{max}$, the maximum width from the centerline 27 of any cross-section along the length $x$ of the reed, at which point the contour of the exposed side 28 of the root region becomes vertical and meets the face side 23 of the root region. The root region 23, 28 extends from the vamp region 22, 26 to the root end 24 of the reed.

Aside from the geometric structure of the synthetic reed, the elastic limit of the material comprising the reed is the second essential feature of this invention. The material of the present invention must be such that when the reed bends in the transverse direction, the reed must be able to bend to the same extent as its cane counterpart without exceeding the elastic limit of the material. Furthermore, the material must be such that when the reed bends in the lengthwise direction, the elastic limit is likewise not exceeded. In this manner the material will experience elastic recovery after the bending within the audio cycle, without any permanent deformation. A material will be suitable if its stress versus strain graph shows a single valued relationship over the range of stress to which the reed is subjected in use. A preferred material is a plastic by the name of Ryton R4 made by the Phillips 66 Corporation. Ryton R4 is a polyphenylene sulfide with 40 percent glass fiber reinforcements. It is injection moldable, thereby permitting a low cost production process. The manufacturer's stress-strain graph for Ryton R4 shows a nearly linear relationship between stress and strain up to the elastic limit. The nearly linear relationship indicates elastic recovery. For the purposes of the present invention, a material by definition experiences elastic recovery within the range of stress where strain is a single valued function of stress. The corresponding strain at the elastic limit is known as the strain limit, and is approximately equal to 0.005 for Ryton R4. Thus, so long as the elastic limit of Ryton R4 is not exceeded, the material will experience elastic recovery after the transverse and longitudinal bending. Given a strain limit of 0.005, in order to accommodate maximum curvatures experienced by a reed adapted for the $B^b$ clarinet, for example, thickness near its tip should not exceed 0.051 millimeters (0.002 inches). The preferred maximum thickness of the inside envelope 18 at the tip end 1 $(Z'_{0,0})$ is therefore 0.051 millimeters.

Figure 18:
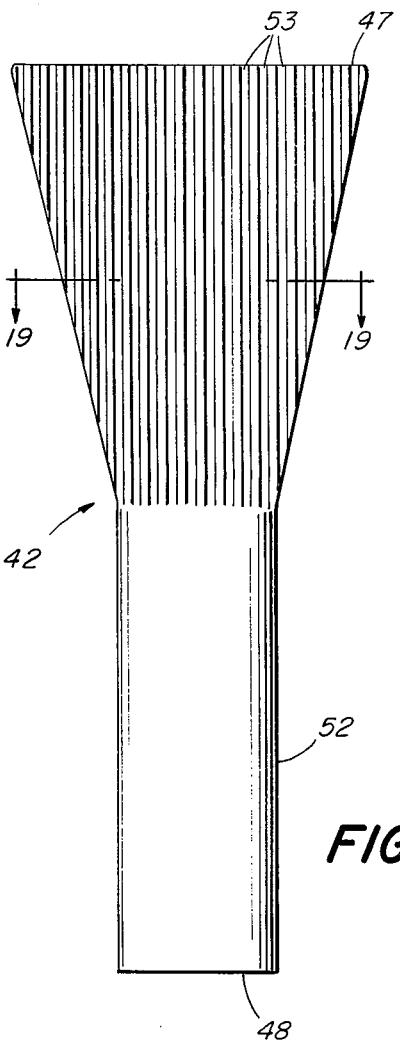
FIG. 18 is a diagrammatic top plan view of one embodiment of a double reed constructed in accordance with the present invention.
Figure 19:
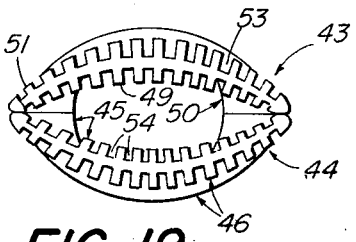
FIG. 19 is a cross-sectional view taken along line 19—19 of FIG. 18.
Figure 20:
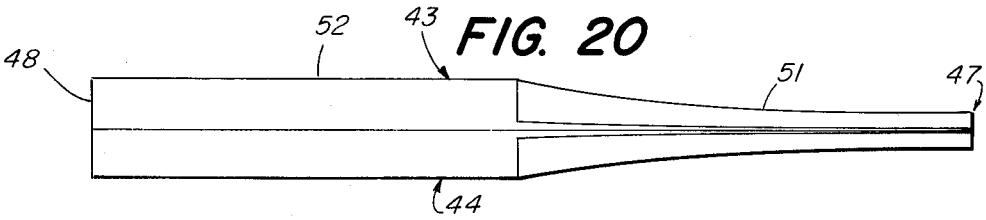
FIG. 20 is a longitudinal side view of the double reed of FIG. 18.

As shown in FIGS. 18 through 20, the present invention can also be adapted for use with double reed woodwind instruments. The double reed 42 comprises a matched pair of similarly shaped component reeds 43, 44 which are joined together to produce a single structure. In a preferred embodiment of the double reed of the present invention, the matched pair of component reeds 43, 44 are identically shaped. Each of the component reeds 43, 44 of the double reed 42 comprises an inner concavely shaped surface 45, an outer convexly shaped surface 46, a tip end 47, and a root end 48. As with the single reed 34 of the present invention, the concave surface 45 of the double reed 42 may be subdivided into the concave vamp surface 49 and the concave root surface 50. Also, the convex surface 46 may be subdivided into the convex vamp surface 51 and the convex root surface 52.

The convex vamp surface 51 of each component reed 43, 44 corresponds in construction generally to the exposed side 26 of the vamp region of the single reed 34, except for a wider tip end 47, as shown in a comparison of FIGS. 3, 18 and 20. The concave vamp surface 49 differs from the face side 22 of the vamp region of the single reed 34, in that a transverse cross section of the former is concave rather than flat. The two component reeds 43, 44 are joined together along their longitudinal edges, in such a manner that the concave surface 45 of the one reed 43 opposes the concave surface of the other reed 44, as shown in FIG. 19. The vamp region of the double reed 42 has channels 53, 54 located in both the concave surface 49 and the convex surface 51, similar to the channels 29, 30 in both the face side 22 and the exposed side 26 of the vamp region of the single reed 34. The root region 50, 52 of each component reed 43, 44 is substantially semicylindrical in shape. When the two component reeds 43, 44 are joined together, the concave root surface 50 of the first reed 43 cooperates with the concave root surface 50 of the second reed 44 to form a hollow cylindrical passage through which air is capable of being passed into the musical instrument when the double reed 42 is mounted thereto. Finally, the material requirements of the single reed 34 also apply to the construction of the double reed 42 of the present invention, and a preferred material is Ryton R4.

Having thus described the principles of the invention, together with illustrative embodiments thereof, it is to be understood that although specific terms are employed they are used in a generic and descriptive sense and not for purposes of limitation, the scope of the invention being set forth in the following claims.

I claim:

1. A reed for a woodwind instrument comprising a strip of material having a non-convex surface, a convex surface curved in the transverse direction, a tip end, and a root end, said non-convex surface and said convex surface forming a vamp region and a root region, said vamp region extending from the tip end to some distance between the tip end and root end, the intersurface distance between said convex surface and said non-convex surface increasing exponentially as a function of longitudinal distance from said tip end for the length of said vamp region, said convex surface having a first set of longitudinal channels therein extending from said tip end along at least a portion of said vamp region, said non-convex surface having a second set of longitudinal channels therein aligned with said first set of channels and extending from said tip end along at least a portion of said vamp region, whereby any transverse cross-section of at least that portion of the vamp region near said tip end comprises a plurality of alternating thicker and thinner regions, said thinner regions being near but not necessarily on the center of gravity of the cross-section.

2. A single reed for a clarinet, saxophone, or the like according to claim 1 wherein said non-convex surface is substantially plane.

3. A double reed for an oboe, bassoon or the like comprising a matched pair of reeds, each constructed according to claim 1, and arranged with their non-convex surfaces facing each other, said non-convex surfaces being concave in the transverse direction.

4. A double reed for a woodwind instrument in accordance with claim 3, wherein said component reeds are joined together along at least a portion of the longitudinal edges thereof.

5. The reed according to claim 1 wherein at any transverse cross-section of at least that portion of said vamp region near said tip end the bottoms of the first set of channels are located a uniform distance from the non-convex surface of the vamp region.

6. The reed according to claim 1 wherein at any transverse cross-section of at least that portion of said vamp region near said tip end the bottoms of the second set of channels are located a uniform distance from the non-convex surface of the vamp region.

7. The reed according to claim 1 wherein all of the channels of said first set of channels and all of the channels of said second set of channels have constant and equal widths.

8. The reed according to claim 1 wherein the material comprising the reed has an elastic limit sufficiently great to withstand the longitudinal and transverse bending of said reed when adapted for use with a woodwind instrument.

9. The reed according to claim 1 wherein the material comprising the reed experiences elastic recovery within the range of stress to which said reed is subjected when adapted for use with a woodwind instrument.

10. The reed according to claim 1 wherein the material comprising the reed is Ryton R4.

11. The reed according to claim 1 wherein the bottoms of the first set of channels and the bottoms of the second set of channels are located an equal distance from the center of gravity of a transverse cross-section of the vamp region, said distance decreasing elliptically as a function of width from the centerline to the outer edges of said transverse cross-section.

* * * * *